US005284209A

United States Patent [19]

Godfrey

[11] Patent Number: 5,284,209

[45] Date of Patent: Feb. 8, 1994

[54] COILED TUBING CUTTING MODIFICATION

[75] Inventor: Craig Godfrey, Richardson, Tex.

[73] Assignee: Halliburton Company, Duncan, Okla.

[21] Appl. No.: 932,391

[22] Filed: Aug. 19, 1992

[51] Int. Cl.[5] ..... E21B 29/00

[52] U.S. Cl. ..... 166/380; 166/55.1; 166/336

[58] Field of Search ..... 166/380, 386, 55, 55.1, 166/55.2, 328, 332, 334, 336

[56] References Cited

U.S. PATENT DOCUMENTS

| | | | |
|---|---|---|---|
| Re. 27,464 | 8/1972 | Taylor, Jr. | 166/.5 |
| 3,411,576 | 11/1968 | Taylor, Jr. | 166/.5 |
| 4,009,753 | 3/1977 | McGill et al. | 166/55.1 |
| 4,160,478 | 7/1979 | Calhoun et al. | 166/55.1 |
| 4,494,609 | 1/1985 | Schwendemann | 166/336 |
| 4,522,370 | 6/1985 | Noack et al. | 251/63.5 |
| 4,658,904 | 4/1987 | Doremus et al. | 166/336 |
| 5,050,839 | 9/1991 | Dickson et al. | 251/58 |

*Primary Examiner*—Thuy M. Bui

*Attorney, Agent, or Firm*—Tracy W. Druce; Lucian Wayne Beavers

[57] ABSTRACT

A subsea test tree having a spherical ball valve member is modified to accommodate cutting of a string of coiled tubing extending through the ball valve member. This is accomplished by providing an eccentric recess in an inner bore of the subsea test tree, with the eccentric recess being positioned to receive a lower portion of the coiled tubing string as the coiled tubing string is cut by the ball valve member. This reduces the plastic deformation of the lower portion of the coiled tubing string as the coiled tubing string is cut by the closing ball valve member, and thus reduces the closing force necessary to reliably cut a coiled tubing string when the spherical ball valve member of the subsea test tree is closed in an emergency situation.

7 Claims, 5 Drawing Sheets

COILED TUBING CUTTING MODIFICATION

BACKGROUND OF THE INVENTION

1. Field of the Invention

The present invention relates generally to test trees for testing and producing offshore wells, and particularly to a modification of such test trees to allow the test tree to cut larger diameters of coiled tubing when the test tree is closed in an emergency situation.

2. Description of the Prior Art

In the production testing of offshore wells, it is desirable to be able to quickly disconnect the production test string from the well in the event of an emergency such as adverse weather conditions. In making the quick disconnect, provision must be made for shutting in the well. This is commonly accomplished with a valve apparatus referred to as a subsea test tree. A subsea test tree is a type of safety valve.

A typical example of a prior art subsea test tree is seen in U.S. Pat. No. 4,494,609 to Schwendemann. Quite often when the production test string is in place in a well, it will be necessary to run other tools down through the production test string and down through the subsea test tree. These other tools are typically run on a wireline or on coiled tubing.

It is common practice with subsea test trees such as that of Schwendemann, when an extreme emergency situation arises, to close the ball valve member of the test tree while the wireline or coiled tubing still extends through the test tree, thus severing the wireline or coiled tubing by the shearing action of the ball valve member against its seat.

As procedures utilizing coiled tubing have evolved, the industry is moving toward use of larger and larger diameters of coiled tubing. This presents an increased difficulty in severing the coiled tubing in emergency situations with a subsea test tree.

Various approaches have been suggested to improve upon the capability of a subsea test tree for cutting these larger strings of coiled tubing.

One approach is that shown in U.S. Pat. No. 4,009,753 of McGill et al. wherein a slot is cut in the lower portion of the spherical ball valve member so that when the ball valve moves to its closed position with a string of coiled tubing still in place, the lower portion of the coiled tubing string will be received in the slot of the ball valve and thus will not be placed in double shear type bending as the ball valve closes. This is best illustrated in FIG. 6 of McGill et al.

Another approach to the problem is seen in U.S. Pat. No. 4,160,478 to Calhoun et al. The Calhoun et al. device does not use a conventional spherical ball valve member, but instead uses a combined cutter/valve operator member mounted eccentrically within the housing and associated with a spherical seat surface which is also developed on an eccentrically positioned center.

SUMMARY OF THE INVENTION

The present invention provides an economical modification to conventional safety valves and subsea test tree devices like that of Schwendemann U.S. Pat. No. 4,494,609 which allows the subsea test tree to cut larger strings of coiled tubing. This is accomplished without placing any recess in the spherical ball valve member, and thus has the major advantage of not weakening the ball by removing material from the ball.

This is accomplished by forming an eccentric recess within the inner bore of the valve housing at a position diametrically opposed to the point where the spherical ball valve member closes upon the coiled tubing to shear the coiled tubing. This allows a lower portion of a coiled tubing string to be received in the eccentric recess and thus substantially reduces the plastic deformation of that lower portion of the coiled tubing string as the ball valve member is closed to shear the coiled tubing. This significantly reduces the closing force necessary to cut a given string of coiled tubing, and thus allows a given subsea test tree design to reliably cut larger strings of coiled tubing than it otherwise could in the absence of the eccentric recess defined in the inner bore of the housing.

Numerous objects, features and advantages of the present invention will be readily apparent to those skilled in the art upon a reading of the following disclosure when taken in conjunction with the accompanying drawings.

BRIEF DESCRIPTION OF THE DRAWINGS

FIG. 1 is separated down its center line. On the left hand side of FIG. 1, the ball valve element is shown in its closed position, and on the right-hand side of FIG. 1 the ball valve element is shown in its open position.

In FIG. 6, the ball valve element is shown in its open position and a string of coiled tubing is shown in place therethrough.

In FIG. 7, the ball valve element is shown at an intermediate position just prior to when the cutting of the coiled tubing between the ball valve member and the upper seat will begin.

In FIG. 8, the ball valve member has moved to its fully closed position thus cutting the coiled tubing. A lower portion of the coiled tubing is seen to have been bent and to be received in the eccentric recess defined in the ball support housing portion.

DETAILED DESCRIPTION OF THE PREFERRED EMBODIMENTS

Figure 1:
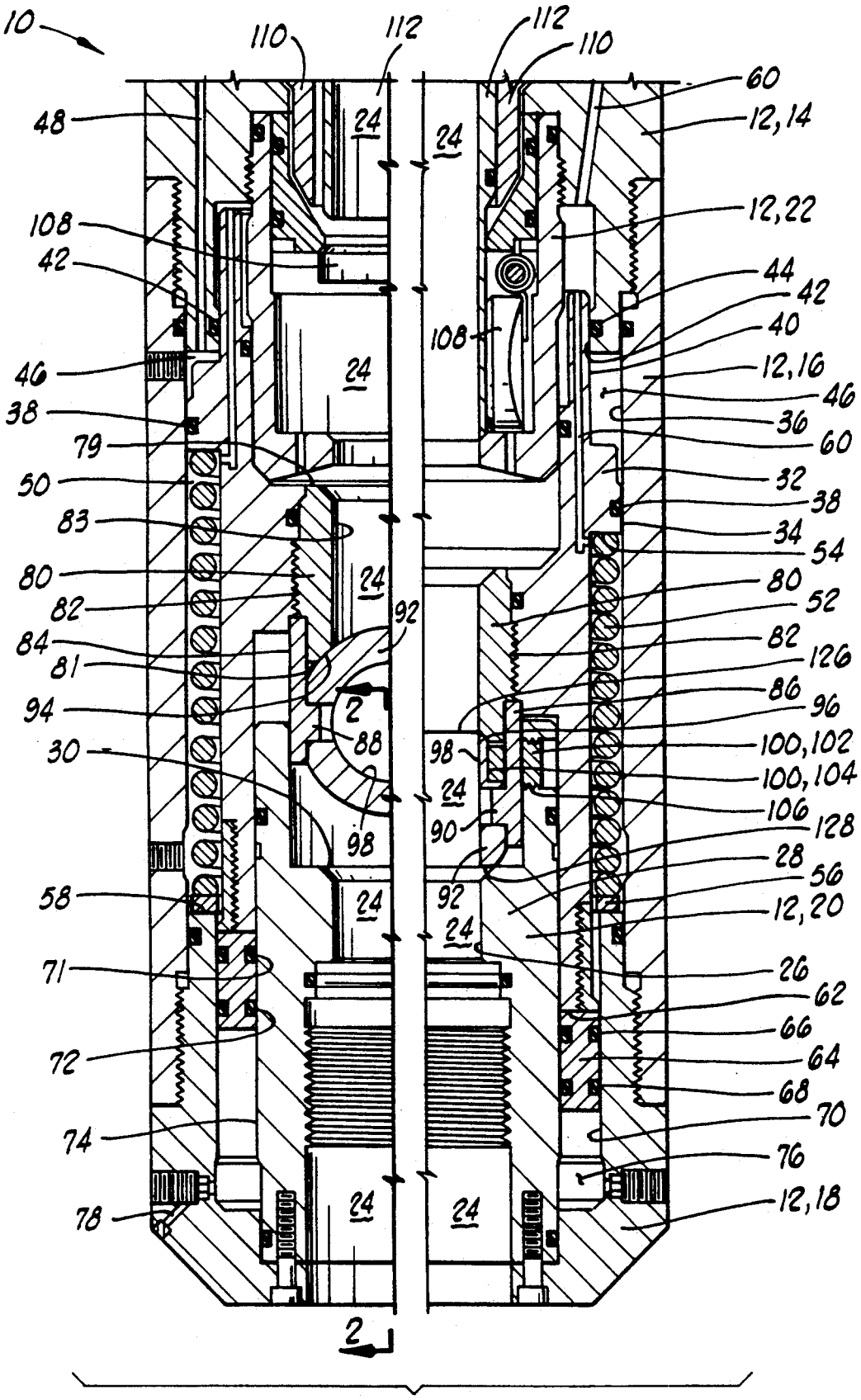
FIG. 1 is an elevation sectioned view of a lower portion of a subsea test tree showing the spherical valve member and surrounding structure.

Referring now to the drawings, and particularly to FIG. 1, the lower portion of a subsea test tree is thereshown and generally designated by the numeral 10. Except for the eccentric recess provided in the inner housing bore by the present invention for the purpose of reducing the forces required to cut coiled tubing, the subsea test tree 10 is substantially identical to that shown in U.S. Pat. No. 4,494,609 to Schwendemann, the details of which are incorporated herein by reference. It will be understood that the modification of the present invention is applicable to other types of safety valves in addition to subsea test trees.

The subsea test tree 10 includes a housing generally designated by the numeral 12. The housing 12 includes, inter alia, a latch sub 14, a spring housing portion 16, a bottom sub 18, a ball support housing section 20, and a flapper housing section 22.

The housing 12 has a longitudinal housing passage generally designated by the numeral 24 defined therethrough. Passage 24 may be referred to as an axial test tree bore 24 or an axial safety valve bore 24.

The ball support housing section 20 has a bore 26 defined therethrough which forms a portion of the longitudinal housing passageway 24. The bore 26 is formed through a radially inward protruding annular flange portion 28 of ball support housing section 20. A tapered annular upward facing support surface 30 is defined on flange 28 at the upper end of bore 26. The support surface 30 is often referred to as a downstop 30.

An operating piston 32 is slidably received within housing 12. Operating piston 32 has a larger diameter outer cylindrical surface 34 slidably received within a bore 36 of spring housing section 16 with an outer O-ring piston seal 38 provided therebetween.

Piston 32 also has a smaller diameter outer cylindrical surface 40 slidably received within a bore 42 of latch sub 14 with an inner piston seal 44 provided therebetween.

A sealed annular control chamber chamber 46 is defined between piston 32 and housing 12 and between inner and outer piston seals 44 and 38.

A control fluid passage 48, a portion of which is seen in latch sub 14 of housing 12, provides control fluid to the control chamber 46 for applying hydraulic pressure to the upper surface of piston 32.

An annular balancing chamber 50 is defined between piston 32 and spring housing section 16 below the outer piston seal 38. A coiled compression spring 52 is received in balancing chamber 50 and is compressed between a downward facing shoulder 54 defined on piston 32 and a spring support ring 56 which rests upon an upper end 58 of bottom sub 18. As is apparent in the right-hand side of FIG. 1, when the piston 32 is moved downward within housing 12, the spring 52 is compressed thus providing a biasing force biasing the piston 32 back upward within the housing 12.

A balancing fluid passage 60 is defined in the housing 12 and provides hydraulic fluid under pressure to the balancing chamber 50 so that hydrostatic fluid pressures due to the column of fluid in the hydraulic control lines will be balanced across piston 32. If desired, additional pressure may be applied through passage 60 to aid closure of the valve member 92.

A lower end 62 of piston 32 abuts an annular floating piston 64. Floating piston 64 has upper and lower outer seals 66 and 68 which seal within a bore 70 of bottom sub 18. Floating piston 64 has upper and lower inner seals 71 and 72 which seal against a cylindrical outer surface 74 of ball support housing section 20. A sealed pressure dome 76 is defined between bottom sub 18 and ball support housing section 20 below the floating piston 64. The pressure dome 76 may be charged with inert gas, such as nitrogen, under pressure through a charging passage 78 when the tool 10 is assembled at the surface. It will be appreciated that the pressure of the gas in dome 76 aids in biasing the piston 32 toward its upper position within the housing 12.

An annular ball carrier 80 is attached to piston 32 at threads 82. First and second control arms 84 and 86 extend downward from carrier 80. The control arms 84 and 86 have first and second pivot pins 88 and 90, respectively, extending laterally inward therefrom.

A spherical ball valve member 92 is rotatably mounted upon the pivot pins 88 and 90.

The ball carrier 80 has upper and lower ends 79 and 81 and has a carrier bore 83 defined longitudinally therethrough. An upper annular seat 94 is defined on the lower end 81 of ball carrier 80 and surrounds the carrier bore 83.

The spherical ball valve member 92 has a spherical outer surface portion 96 sealingly engaging the upper annular seat 94. The ball valve member 92 is carried longitudinally relative to housing 12 by the ball carrier 80 as the ball carrier 80 is reciprocated within housing 12 by piston 32. The spherical ball valve member 92 has a ball valve bore 98 extending therethrough which forms a portion of the longitudinal housing passage 24 when the ball valve member 92 is in its open position as shown in the right-hand side of FIG. 1.

An eccentric actuator means 100 interconnects the ball valve member 92 and the ball support section 20 of housing 12 for rotating the ball valve member 92 between its open position as shown in the right-hand side of FIG. 1 and its closed position as shown in the left-hand side of FIG. 1 as the piston 32 moves the ball carrier 80 between its lowermost position relative to housing 12 as seen in the right-hand side of FIG. 1 and its uppermost position relative to the housing 12 as seen in the left-hand side of FIG. 1. The eccentric actuator means 100 includes a plurality of eccentrically located actuator pins 102 received in a pair of eccentric slots 104 defined on opposite sides of the ball valve member 92. Pins 102 preferably have thin nitrided bushings (not shown) received thereabout to provide a bearing as pins 102 slide in slots 104. The pins 102 are attached to ball support section 20 of housing 12 such as at threads 106. Thus the actuating pins 102 remain fixed relative to housing 12 while the ball valve member 92 reciprocates relative to housing 12, and the eccentric offset between pivot pins 88, 90 and eccentric actuator pins 102 causes the spherical ball valve member 92 to pivot about pins 88, 90 between its open position as shown in the right-hand side of FIG. 1 and its closed position as shown in the left-hand side of FIG. 1.

As seen in the upper part of FIG. 1, a flapper valve element 108 is received within flapper housing section 22.

A lower end of a stinger portion 110 of test tree 10 is seen in the upper portion of FIG. 1 as being received within the housing 12. A hydraulically actuated stinger tube 112 is located within the stinger portion 110 and is hydraulically actuated in a known manner to open the flapper valve 108.

Figure 2:
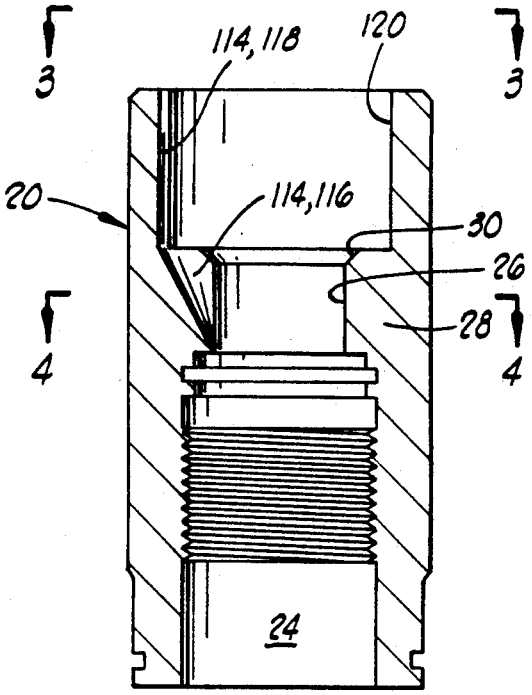
FIG. 2 is an elevation sectioned view of the ball support portion of the subsea test tree housing, taken along line 2—2 of FIG. 1 and illustrating in sectioned profile the eccentric recess which has been formed in the ball support housing portion of the housing.

FIG. 2 is an elevation sectioned view taken along line 2—2 of the ball support section 20 of housing 12. The ball support housing section 20 has an eccentric recess, which may also be referred to as a lateral housing recess 114 defined therein. The eccentric recess 114 interrupts the lower annular flange 18 and downstop 30 and intersects the bore 28 of support housing section 20. The recess 114 has a lower portion 116 which is actually defined within the flange portion 28 of ball support section 20 and further includes an upper portion 118 which extends vertically upward to elevations higher than the inner annular flange 28 and downstop 30. The upper portion 118 forms a longitudinal upwardly extending groove in an upper bore 120 of the ball support section 20.

Figure 3:
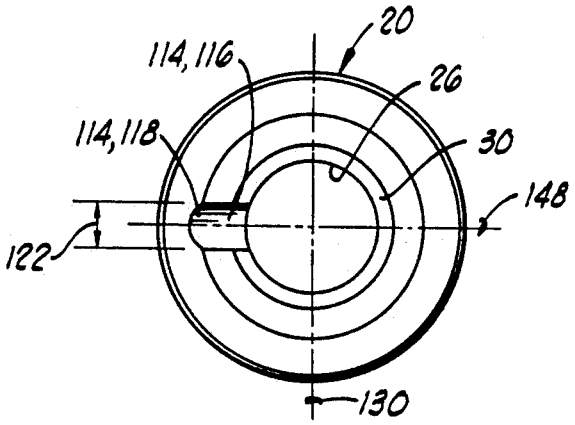
FIG. 3 is a plan view of the ball support housing portion of FIG. 2 taken along line 3—3 of FIG. 2.
Figure 4:
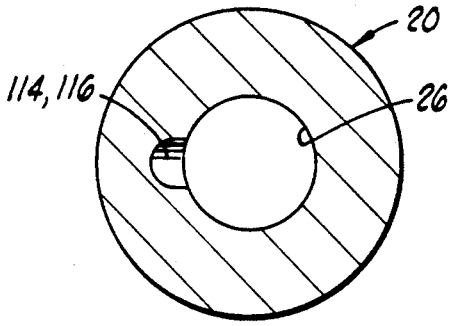
FIG. 4 is a sectioned view of the ball support housing portion of FIG. 2 taken along line 4—4 of FIG. 2.

FIG. 3 is a plan view of the ball support section 20 of FIG. 2 taken along line 3—3 of FIG. 2, and FIG. 4 is a sectioned view of the ball support section 20 taken along line 4—4 of FIG. 2. FIGS. 2, 3 and 4 taken together depict the shape of the entire eccentric recess 114.

Figure 8:
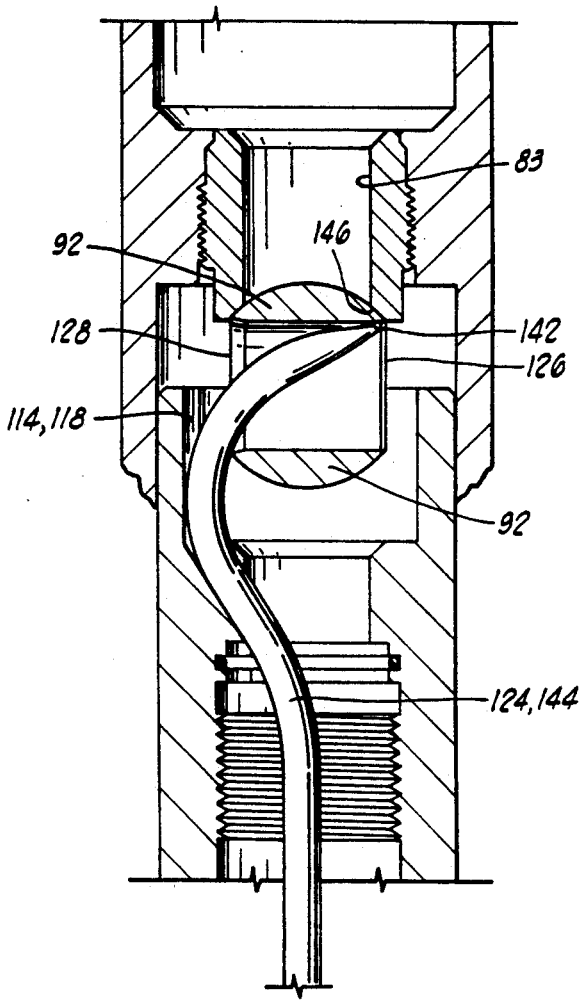

The eccentric recess 114 has a lateral width 122 sufficiently wide to receive a length of coiled tubing 124 (see FIG. 8). For example, the lateral width 122 of eccentric recess 114 may be approximately 1.75 inches for use with 1.5 inch nominal diameter coiled tubing.

When the ball valve member 92 is in its open position as seen in the right-hand side of FIG. 1, it can be described as having upper and lower end surfaces 126 and 128.

Figure 5:
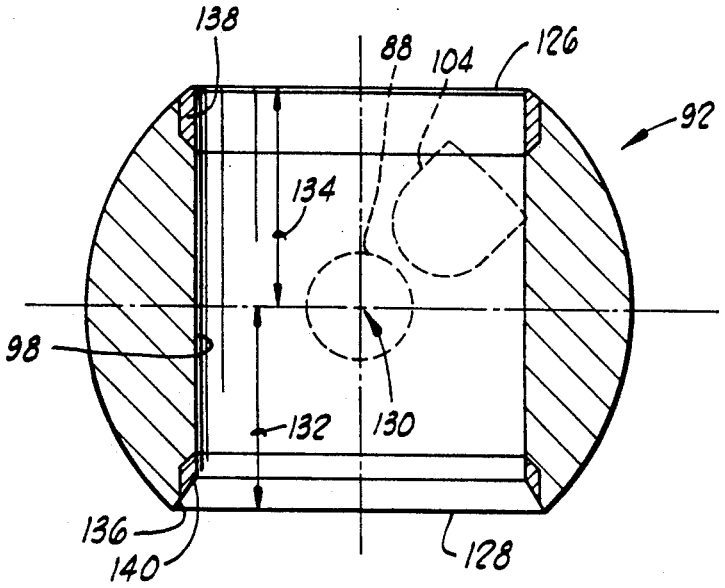
FIG. 5 is a sectioned view of the spherical ball valve member showing its shortened lower end.

FIG. 5 is an enlarged sectioned view of the ball valve element 92 which is oriented as the ball valve element 92 would be seen if sectioned along line 2—2 of FIG. 1 with the ball valve element 92 in its open position as seen in the right-hand side of FIG. 1. The orientation of the ball valve element 92 seen in FIG. 5 also corresponds to the orientation seen in FIG. 6. Also shown in dashed lines in FIG. 5 are the locations of the pivot pin 88 and one of the eccentric actuator slots 104.

The ball valve member 92 as seen in FIG. 5 has had the lower end surface 128 cut away entirely around the ball valve bore 98 so that a first distance 132 from pivot axis 130 to the lower end surface 128 is less than a second distance 134 from the pivot axis 130 to the upper end surface 126.

For example on a typical valve having a three-inch nominal inside diameter of the ball valve bore, the first dimension 132 could be within the range from 1.78 to 1.83 inches whereas the second dimension 134 would be 1.93 inches.

Figure 6:
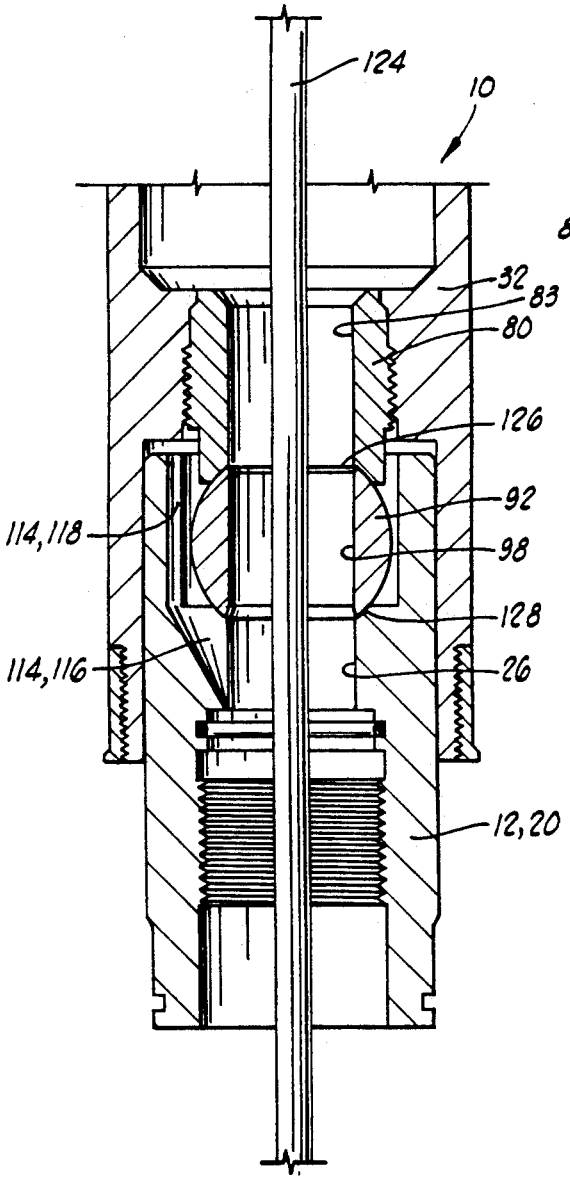
FIGS. 6, 7 and 8 comprise a sequential series of illustrations of that portion of the subsea test tree surrounding the ball valve element illustrating the closing of the ball valve element to cut a string of coiled tubing in place therethrough.
Figure 7:
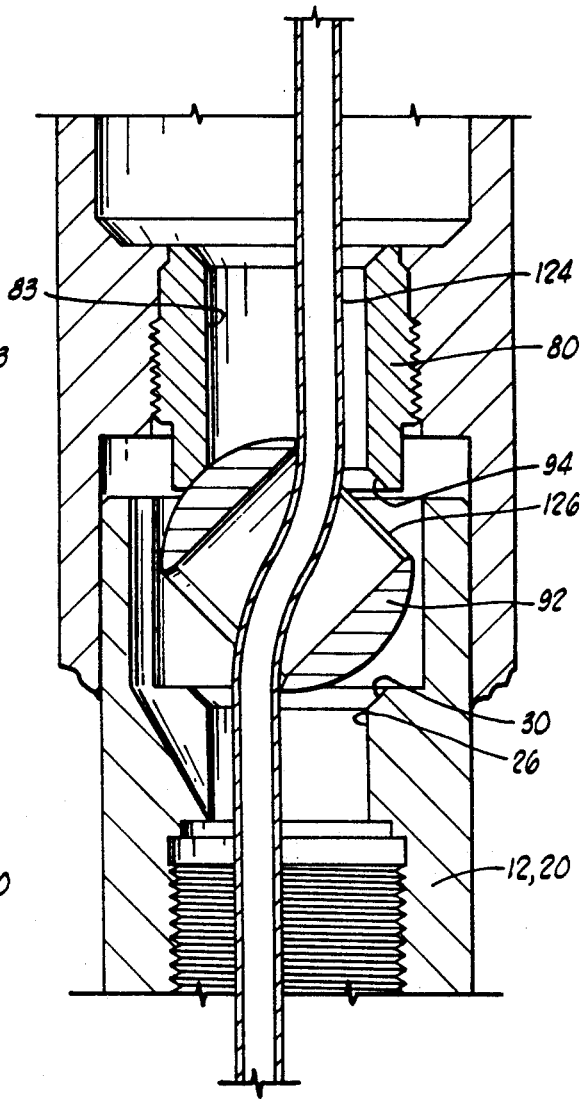

It will be appreciated that as the ball valve member 92 moves to its closed position as represented in the sequence of FIGS. 6, 7 and 8, the shortening of the distance 132 will provide more clearance between the lower end 128 of ball valve member 92 and the eccentric recess 114 so as to provide more room for the coiled tubing string 124 and thus further minimizing the plastic deformation of the coiled tubing 124 received in the eccentric recess 114.

Other details of the preferred construction of the ball valve member 92 are also seen in FIG. 5. A lower inner beveled surface 136 is preferably provided to also accommodate the curvature of the coiled tubing string 124 when the ball valve member is closed. Additionally, there is an annular upper hard facing 138 and an annular lower hard facing 140 formed at the upper and lower ends, respectively, of ball valve bore 98.

As is seen in FIG. 5, the ball valve bore 98 of ball valve member 92 defines a continuous cylindrical inner surface 98 which is free of any intersecting recesses which would significantly weaken the ball valve member.

FIGS. 6, 7 and 8 provide a sequential series of figures which illustrate the manner of operation of the subsea test tree 10 when it is closed with a string of coiled tubing 124 extending therethrough.

In FIG. 6, the ball valve member 92 is seen in its lowermost open position like that shown in the right-hand side of FIG. 1.

As the piston 32 moves upward relative to the housing 12 carrying the ball valve member 92 with it, the ball valve member 98 begins to pivot in a clockwise direction as seen in FIGS. 6–8. FIG. 7 shows the ball valve member 92 in an intermediate position where it is raised somewhat above the downstop 30. The coiled tubing string 124 has been placed in an S-type bend and the upper end 126 of ball valve member 92 is about to begin deforming and cutting the coiled tubing string 124 as the coiled tubing string 124 is sheared between the upper end 126 of ball valve member 92 and the annular seat 94.

As the ball valve member 92 moves to its fully closed position shown in FIG. 8, the coiled tubing 124 is sheared as shown by cut end 142, and the lower portion 144 of the coiled tubing string 124 is deformed so that it is at least partially received in the eccentric recess 114 as seen in FIG. 8.

It will be appreciated that as the ball valve member 92 moves to its closed position shown in FIG. 8, it will define a final point of closing of the carrier bore 83 which final point of closing will lie in the plane of FIG. 8 and is indicated by the numeral 146. This final point of closing 146 is diametrically opposed from the eccentric recess 114. An imaginary lateral line 148 (see FIG. 3) between the final point of closing 146 and a lateral axis of eccentric recess 114 is perpendicular to the pivotal axis 130 of ball valve member 92.

The superposition of the imaginary lateral line 148 and the pivotal axis 130 is shown in FIG. 3 for purposes of illustration. It will be understood that those lines do not actually lie in the plane of FIG. 3.

It is noted that when the ball valve member 92 is in its upper closed position as illustrated in FIG. 8, it is located above most of the eccentric recess 114.

As seen in FIG. 8, the lower portion 144 of the coiled tubing string 124 is plastically deformed. This plastic deformation is substantially reduced due to the modifications of the present invention, as compared to the deformation which occurs with the prior art apparatus of Schwendemann U.S. Pat. No. 4,494,609.

Figure 9:
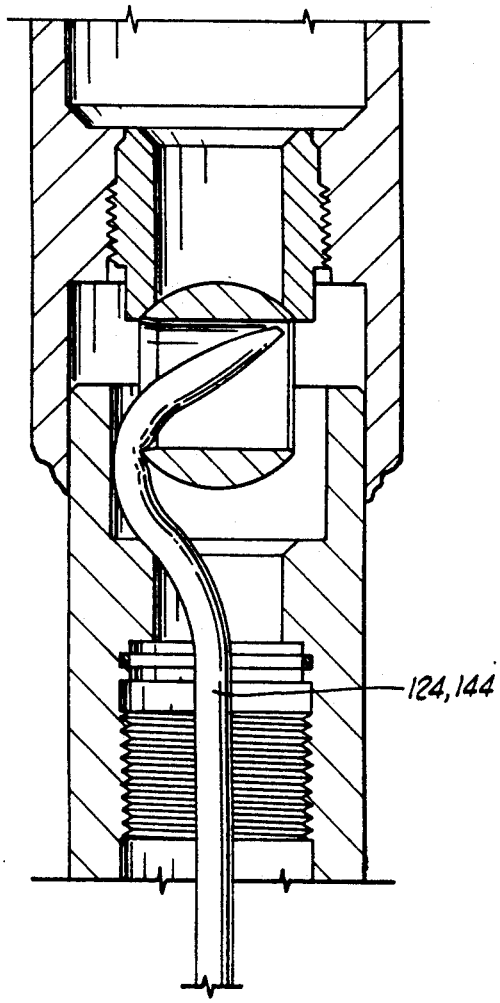
FIG. 9 PRIOR ART
FIG. 9 is a view similar to FIG. 8, but without the eccentric recess of the present invention, thus illustrating and contrasting the much more severe plastic deformation of the lower coiled tubing portion that occurs when cutting coiled tubing with a prior art subsea test tree.

FIG. 9 illustrates the plastic deformation of the coiled tubing string 124 which occurs with the prior art apparatus like that of Schwendemann U.S. Pat. No. 4,494,609 which does not have the eccentric recess 114.

The bending of the lower portion 144 of coiled tubing string 124 which must be accomplished with the test tree 10 of the present invention having the eccentric recess 114 is substantially less than that with the prior art apparatus like that of FIG. 9. This greatly reduces the closing force necessary to close the ball valve element 92 and sever the coiled tubing string 124, thus permitting the test tree 10 to reliably sever larger diameter coiled tubing strings 124 than it otherwise could.

Turning now to FIGS. 10–13, the application of the modifications of the present invention to a slightly different design of safety valve are illustrated.

Figure 10:
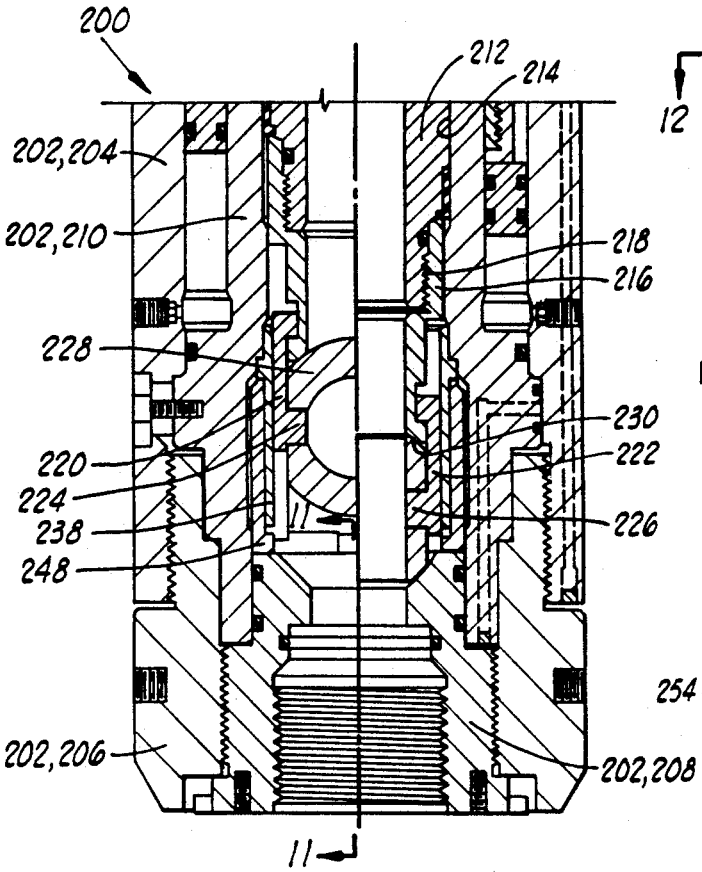
FIG. 10 is an elevation sectioned view similar to FIG. 1 of a modified form of safety valve which includes control frames and a control sleeve which support the control arms and thus reduce flexing of the control arms and twisting of the ball during cutting of the coiled tubing. This type of safety valve has a somewhat different configuration of its ball support housing portion.

FIG. 10 illustrates a lower portion of a safety valve which is generally designated by the numeral 200. Except for the recess 254 of the present invention, the safety valve 200 is substantially like that shown in FIG. 10 of U.S. Pat. No. 5,050,839 to Dickson et al., the details of which are incorporated herein by reference. The safety valve 200 includes a housing 202 having an outer spring housing section 204, a bottom sub 206, a ball support housing section 208, and a concentric inner housing section 210.

A lower end of a piston 212 is seen slidably received within a bore 214 of concentric inner housing section 210.

A ball carrier 216 is attached to the lower end of piston 212 at thread 218.

First and second control arms 220 and 222 extend downward from ball carrier 216 and have first and second pivot pins 224 and 226 extending laterally inward therefrom.

A spherical ball valve member 228 is journaled on the pivot pins 224 and 226 and sealingly engages an annular seat 230 defined on the lower end of the ball carrier 216.

Figure 13:
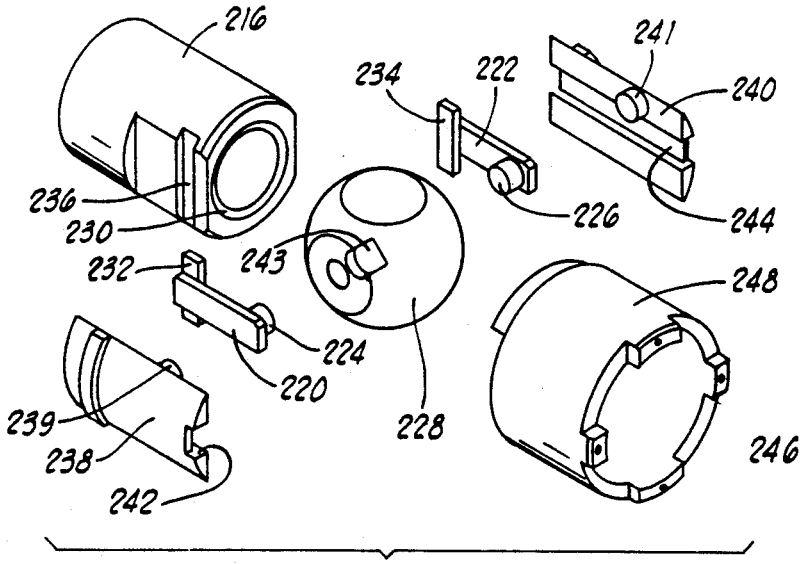
FIG. 13 is an exploded view of the upper seat, ball, control arms, control frames and control sleeve of the safety valve of FIG. 10.

As best seen in FIG. 13, the first and second control arms 220 and 222 have upper T-shaped cross members 232 and 234 which are received in outer horizontal slots such as 236 defined in the ball carrier 216.

Located radially outward from the control arms 220 and 222 are first and second control frames 238 and 240. The control frames 238 and 240 have vertical inner slots 242 and 244 defined therein within which are slidably received the vertical members of the support arms 220 and 222, respectively.

The control frames 238 and 240 have actuator pins 239 and 241 extending laterally inward therefrom for receipt in eccentric actuator recesses such as 243 in the ball valve member 228.

The control frames 238 and 240 are in turn received within an inner bore 246 of a cylindrical control sleeve 248.

As best seen in FIG. 10, the cylindrical control sleeve 248 is fixed relative to the housing 12 and is held in place between the concentric inner housing section 210 and the ball support housing section 208.

The control frames 238 and 240 and control sleeve 248 serve to prevent flexing of the control arms 220 and 222 and thus to prevent twisting of the spherical ball valve member 228 as it cuts through the coiled tubing string 124. Thus, the presence of control frames 238 and 240 and control sleeve 248 contribute to the ability of the safety valve 200 to cut larger diameter strings of coiled tubing.

Figure 11:
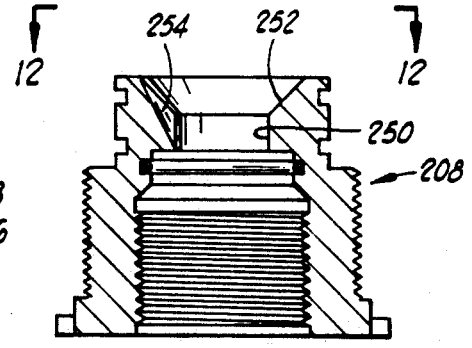
FIGS. 11 and 12 are views similar to FIGS. 2 and 3 illustrating the eccentric recess formed in the ball support housing portion for a safety valve of the type shown in FIG. 10.
Figure 12:
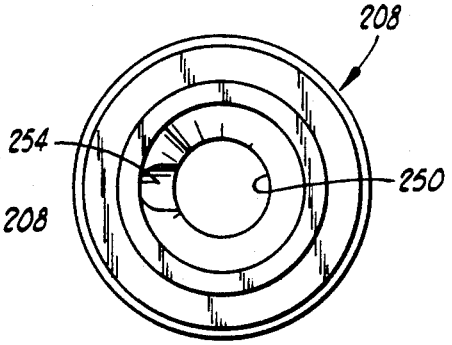

FIGS. 11 and 12 are elevation sectioned and plan views, respectively, of the ball support housing section 208. Ball support housing section 208 has a bore 250 defined therethrough and has an annular tapered ball support surface or downstop 252 defined at the upper end thereof. Bore 250 and downstop 252 are generally analgous to the bore 26 and downstop 30 of the subsea test tree 10 of FIG. 1.

An eccentric recess 254 is formed in the ball support housing section 208 and communicates with the bore 250 thereof to accommodate the lower portion 144 of tubing string 124 when the ball valve member 228 is moved to a closed position analogous to that described for the eccentric recess 114 above with regard to the subsea test tree 10.

Thus it is seen that the apparatus and methods of the present invention readily achieve the ends and advantages mentioned as well as those inherent therein. While certain preferred embodiments of the invention have been illustrated and described for purposes of the present disclosure, numerous changes may be made by those skilled in the art which changes are encompassed within the scope and spirit of the present invention as defined by the appended claims.

What is claimed is:

1. A valve apparatus for use with a string of coiled tubing extending therethrough, comprising:

a housing having a longitudinal housing passage defined therethrough;

an annular ball carrier reciprocably disposed in said housing, said ball carrier having upper and lower ends and having a carrier bore defined longitudinally therethrough, said ball carrier having an annular seat defined on its said lower end and surrounding said carrier bore;

first and second control arms extending downward from said carrier;

a spherical ball valve member pivotally mounted on said control arms and having a spherical outer surface portion sealingly engaging said annular seat, said ball valve member being carried longitudinally relative to said housing by said ball carrier, said ball valve member having a ball valve bore extending therethrough;

eccentric actuator means, interconnecting said ball valve member and said housing, for rotating said ball valve member between an open position and a closed position as said ball carrier and said ball valve member reciprocate longitudinally relative to said housing, said ball valve member being in its said open position when said ball carrier is in a lowermost position relative to said housing, and said ball valve member being in a closed position when said ball carrier is in an uppermost position relative to said housing; and said housing having a lateral housing recess means defined therein interrupting said longitudinal housing passage for receiving a lower portion of said string of coiled tubing extending through said longitudinal housing passageway to reduce the plastic deformation of said lower portion of said string of coiled tubing and thus reduce a closing force necessary to cut said coiled tubing adjacent said annular seat as said ball valve member moves to its said closed position.

2. The apparatus of claim 1, wherein:

said housing has an upward facing support surface defined therein which is engaged by said ball valve member when said ball carrier is in its lowermost position relative to said housing; and said lateral housing recess means interrupts said upward facing support surface and extends vertically upward into an upper portion of said housing located at a higher elevation than said upward facing support surface.

3. The apparatus of claim 1, wherein:

an imaginary lateral line between a final point of closing of said ball valve member against said annular seat and a lateral axis of said lateral housing recess means is perpendicular to a pivotal axis of said ball valve member.

4. The apparatus of claim 1, wherein:

said ball valve bore of said ball valve member defines a continuous cylindrical inner surface free of any intersecting recesses which would significantly weaken said ball valve member.

5. A valve apparatus, comprising:

a housing having a longitudinal housing passage defined therethrough and having an eccentric internal recess defined in said housing passage;

an annular ball carrier reciprocably disposed in said longitudinal housing passage, said ball carrier having upper and lower ends and having a carrier bore defined longitudinally therethrough, said ball carrier having an annular seat defined on its said lower end and surrounding said carrier bore;

first and second control arms extending downward from said carrier;

a spherical ball valve member pivotally mounted on said control arms and having a spherical outer surface portion sealingly engaging said annular seat, said ball valve member being carried longitudinally relative to said housing by said ball carrier, said ball valve member having a ball valve bore extending therethrough;

eccentric actuator means, interconnecting said ball valve member and said housing, for rotating said ball valve member between an open position and a closed position as said ball carrier and said ball valve member reciprocate longitudinally relative to said housing; and said ball valve member being in its said open position with said ball valve bore aligned with said carrier bore when said ball carrier is in a lower position relative to said housing, and said ball valve member being in its said closed position with said spherical outer surface portion blocking said carrier bore when said ball carrier is in an upper position relative to said housing, said ball valve member being arranged so as to define a final point of closing of said carrier bore as said spherical outer surface portion closes said carrier bore, said final point of closing being diametrically opposed from said eccentric internal recess of said housing, said ball valve member being located above at least a portion of said eccentric internal recess when said ball carrier is in its said upper position.

6. The apparatus of claim 5, wherein:

said ball valve bore of said ball valve member defines a continuous cylindrical inner surface free of any intersecting recesses which would significantly weaken said ball valve member.

7. A method of closing in a well, comprising:

(a) providing a safety valve having an axial safety valve bore defined therethrough and including a ball valve member having a ball valve bore therethrough, said ball valve member being so arranged and constructed to be moved between an open position wherein said ball valve bore is aligned with said axial safety valve bore, and a closed position wherein said ball valve member closes said axial safety valve bore, said ball valve member defining a point of final closure of said safety valve bore as said ball valve member moves to its said closed position, said safety valve having defined therein an eccentric recess in said axial safety valve bore, said eccentric recess being diametrically opposite said point of final closure;

(b) running a length of coiled tubing down through said axial safety valve bore and through said ball valve bore when said ball valve member is in its said open position, to perform an operation in said well below said safety valve; and (c) moving said ball valve member to its said closed position with said length of coiled tubing still extending downward through said axial safety valve bore and during said moving:

(1) receiving a lower portion of said length of coiled tubing below said ball valve member in said eccentric recess to reduce the plastic deformation of said lower portion of said length of coiled tubing; and (2) cutting said coiled tubing with said ball valve member as said ball valve member moves to its said closed position, wherein a closing force necessary to cut said coiled tubing as said ball valve member moves to its said closed position is reduced as compared to a closing force which would otherwise be required in the absence of said eccentric recess.

* * * * *